US010226948B2

(12) United States Patent
Fujita et al.

(10) Patent No.: US 10,226,948 B2
(45) Date of Patent: Mar. 12, 2019

(54) IMAGE FORMING APPARATUS

(71) Applicant: CANON KABUSHIKI KAISHA, Tokyo (JP)

(72) Inventors: Takashi Fujita, Kashiwa (JP); Yoshiro Nishino, Kashiwa (JP); Nobuhiro Tani, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/190,547

(22) Filed: Jun. 23, 2016

(65) Prior Publication Data

US 2016/0376119 A1 Dec. 29, 2016

(30) Foreign Application Priority Data

Jun. 25, 2015 (JP) ..... 2015-127426

(51) Int. Cl.
*B41J 13/10* (2006.01)
*G03G 21/16* (2006.01)

(52) U.S. Cl.
CPC ..... *B41J 13/106* (2013.01); *B65H 2301/542* (2013.01); *B65H 2402/44* (2013.01);
(Continued)

(58) Field of Classification Search
CPC ..... B65H 2402/44; B65H 2402/46; B65H 2551/29; B65H 2301/542; B65H 2515/84; B65H 2404/72; B65H 2405/1136; B65H 2405/1138; B65H 2557/61; B65H 2557/64; B65H 2557/65; B41J 13/106
(Continued)

(56) References Cited

U.S. PATENT DOCUMENTS

D218,201 S * 7/1970 Wagner et al. ..... D18/38
7,641,056 B2 1/2010 Schulman
(Continued)

FOREIGN PATENT DOCUMENTS

JP 07-77843 A 3/1995
JP 2002-040737 A 2/2002
(Continued)

OTHER PUBLICATIONS

Xerox(R) Digital Color Press brochure, available at http://www.office.xerox.com/latest/X70BR-01U.pdf [internet] (Year: 2009).*

*Primary Examiner* — Michael C McCullough
(74) *Attorney, Agent, or Firm* — Venable LLP

(57) ABSTRACT

An image forming apparatus includes an image forming station for forming an image on the basis of image information; a top plate portion provided in an upper portion and including a stacking surface having a length in a predetermined direction longer than a length of a short side of a maximum size sheet on which the image forming station is capable of forming the image and shorter than a length of a long side of the maximum size sheet; a wall portion projected upwardly at a position of one end portion with respect to the predetermined direction of the top plate portion and provided with a wall surface inclined so as to form an obtuse angle between itself and the stacking surface of the top plate portion; and a connecting portion having a curved surface configured to connect the stacking surface and the wall surface with each other.

17 Claims, 7 Drawing Sheets

(52) U.S. Cl.
CPC ..... *B65H 2402/46* (2013.01); *B65H 2551/29* (2013.01); *B65H 2601/325* (2013.01); *B65H 2701/193* (2013.01); *G03G 21/1604* (2013.01)

(58) Field of Classification Search
USPC ..... D18/36–41, 45, 50–53, 56, 59
See application file for complete search history.

(56) References Cited

U.S. PATENT DOCUMENTS

| | | | | |
|---|---|---|---|---|
| 2008/0259374 | A1* | 10/2008 | Mestha ..... | G01J 3/46<br>358/1.13 |
| 2008/0262656 | A1* | 10/2008 | Gauronski ..... | G03G 15/5012<br>700/275 |
| 2011/0142468 | A1* | 6/2011 | Fujikura ..... | G03G 15/2053<br>399/67 |
| 2013/0047874 | A1* | 2/2013 | Kanaoka ..... | G03G 21/1604<br>101/171 |
| 2016/0085200 | A1 | 3/2016 | Fujita et al. | |

FOREIGN PATENT DOCUMENTS

| | | | |
|---|---|---|---|
| JP | 2006-011615 | A | 1/2006 |
| JP | 2007-188106 | A | 7/2007 |
| JP | 2009-513394 | A | 4/2009 |
| JP | 2012-019896 | A | 2/2012 |
| JP | 2014-186356 | A | 10/2014 |

* cited by examiner

IMAGE FORMING APPARATUS

FIELD OF THE INVENTION AND RELATED ART

The present invention relates to an image forming apparatus. In particular, it relates to the structure of the top plate portion of the main assembly of the apparatus, which is utilized as a work area.

An electrophotographic image forming apparatus has been widely utilized as a copying machine, a printing machine, a facsimile machine, and also, a multifunction machine having two or more functions of the preceding machines. An electrophotographic image forming apparatus has a merit that unlike an offset printing machine, it does not require a printing plate. In recent years, therefore, an electrophotographic image forming apparatus has been developed into an image forming apparatus aimed for a POD (Print On Demand) market, that is, a printing market in which each job requires only a small number of prints.

There are occasions in which prints outputted from an image forming apparatus are placed on the work area of the top surface of the main assembly of the apparatus to carry out such operations as examining (measuring) the prints. In these occasions, the prints are often rotationally moved to be changed in orientation. Therefore, it sometimes occurs that the prints are accidentally made to fall behind the apparatus. Once the prints fall behind the apparatus, it may take a substantial amount of time and effort to recover the prints from behind the apparatus, in particular in a case where the apparatus happens to be a POD printing machine, because a POD printing machine is rather large. Moreover, it is possible that the prints will be damaged, and therefore, an additional printing job will be required to replace the damaged prints.

Thus, various image forming apparatuses capable of preventing the problem that prints or the like placed on the work area of the top surface of the main assembly of an electrophotographic image forming apparatus fall behind the main assembly have been developed. As one of these types of image forming apparatuses, there has been known the image forming apparatus (disclosed in Japanese Laid-open Patent Application No. 2002-40737), which is provided with a cover for an original placement plate, which is supported by four rotatable supporting members and is horizontally movable (in parallel to original placement plate), and a vertical guard (sheet catching) wall which extends upward from the rear wall of the apparatus. In the case of this image forming apparatus, as the cover for the original placement plate is opened, it comes into contact with the guard wall, and remains vertical. Therefore, the prints or the like on the cover are prevented by the guard wall from falling behind the main assembly of the apparatus.

There has been known another image forming apparatus (Japanese Laid-open Patent Application No. H07-77843) which is designed to prevent prints or the like placed on the top surface of the apparatus from falling behind the main assembly of the apparatus. In the case of this apparatus, it is provided with a vertical panel which is disposed so that it extends vertically upward from the rear wall of the main assembly of the apparatus. Therefore, even if an original placed on the original placement plate, and/or prints or the like placed on the work area of the top plate of the main assembly, happens to be moved rearward, they come into contact with the panel, being therefore prevented from falling behind the main assembly.

However, in the case of the image forming apparatuses disclosed in the abovementioned Japanese Laid-open Patent Applications No. 2002-40737 and No. H07-77843, the guard wall or panel (which hereafter may be referred to as "vertical wall") which is at the rear edge of the top surface of the main assembly of the apparatus is perpendicular to the work area of the top surface of the main assembly. Therefore, it is possible that as a print placed on the work area of the top surface of the main assembly is rotationally moved, a corner portion of the print will be bent by coming into contact with the vertical wall. As the print is bent at the corner, another job has to be carried out to replace the damaged print. That is, it requires additional time.

SUMMARY OF THE INVENTION

The primary object of the present invention is to provide an image forming apparatus which is unlikely to cause the problem that as a sheet of recording medium placed on a portion of the top surface of the main assembly of the apparatus, which is utilized as a work area, is moved, the sheet is damaged.

According to an aspect of the present invention, there is provided an image forming apparatus comprising an image forming station configured to form an image on the basis of image information; a top plate portion provided in an upper portion and including a stacking surface having a length in a predetermined direction which is longer than a length of a short side of a maximum size recording material on which said image forming station is capable of forming the image and shorter than a length of a long side of the maximum size recording material; a wall portion projected upwardly at a position of one end portion with respect to the predetermined direction of said top plate portion and provided with a wall surface inclined so as to form an obtuse angle between itself and said stacking surface of said top plate portion; and a connecting portion having a curved surface configured to connect said stacking surface and said wall surface with each other.

Further features of the present invention will become apparent from the following description of exemplary embodiments with reference to the attached drawings.

Figure 1:
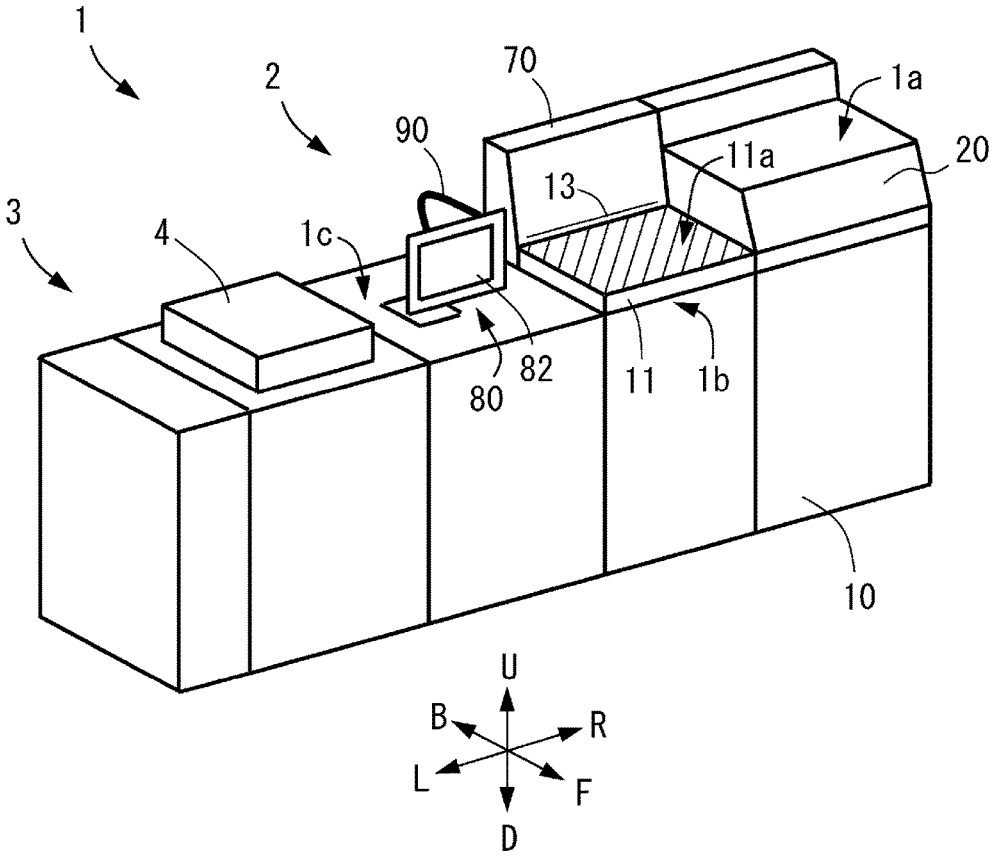
FIG. 1 is a schematic perspective view of the typical image formation system in one of preferred embodiments of the present invention.
Figure 8:
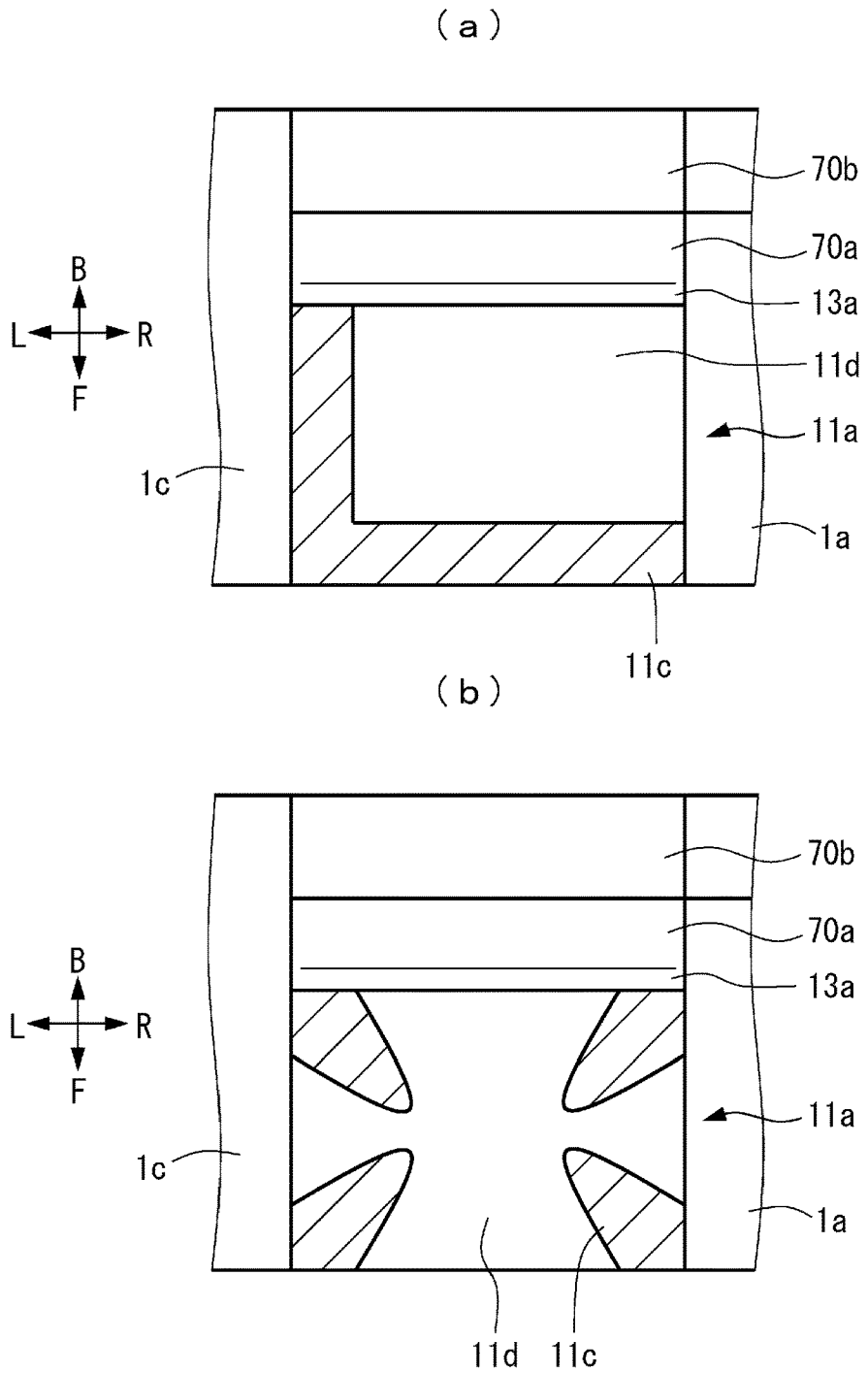

Part (a) of FIG. 8 and part (b) of FIG. 8 are schematic top views of a modified version of the dark portion of the work area of the top surface of the image forming apparatus shown in FIG. 1, part (a) of FIG. 8 showing an L-shaped dark area, which extends along the front and left edges of the work area, and part (b) of FIG. 8 showing a combination of four dark areas which extend from the four corners of the work area, one for one, toward the center of the work area.

DESCRIPTION OF THE EMBODIMENTS

Hereinafter, one of the preferred embodiments of the present invention is described in detail with reference to FIGS. 1-6. By the way, regarding the orientation of the image forming apparatus 2 in this embodiment, the front, rear (back), left, right, top and bottom sides of the image forming apparatus 2 are referred to as F, B, L, R, U and D, respectively.

Referring to FIG. 1, the image formation system 1 in this embodiment comprises the image forming apparatus 2 and an optional delivery device 3. The image forming apparatus 2 is a printer, for example. The delivery device 3 is disposed on the left (L) side of the image forming apparatus 2 as seen from the front (F) side of the apparatus 2. It is a device onto which a print (sheet S of recording medium, on which image was formed) is discharged from the image forming apparatus 2 in a manner to be laid upon the preceding prints. It has three upwardly facing flat surfaces 1*a*, 1*b* and 1*c*. On the flat surface 1*b*, a top plate 11, which will be described later, and an electrical unit 70, are disposed. On the flat surface 1*c*, a control portion 80 is disposed. On the top surface of the optional delivery device 3, an original reading device 4, which is capable of reading an original, is disposed.

In this embodiment, the image forming apparatus 2 is a full-color printer of the so-called tandem type. However, the application of the present invention is not limited to an image forming apparatus of the tandem type. That is, the present invention is also applicable to an image forming apparatus of any of the other types. Further, the application of the present invention is not limited to a full-color image forming apparatus. That is, the present invention is also applicable to a monochromatic image forming apparatus.

Figure 2:
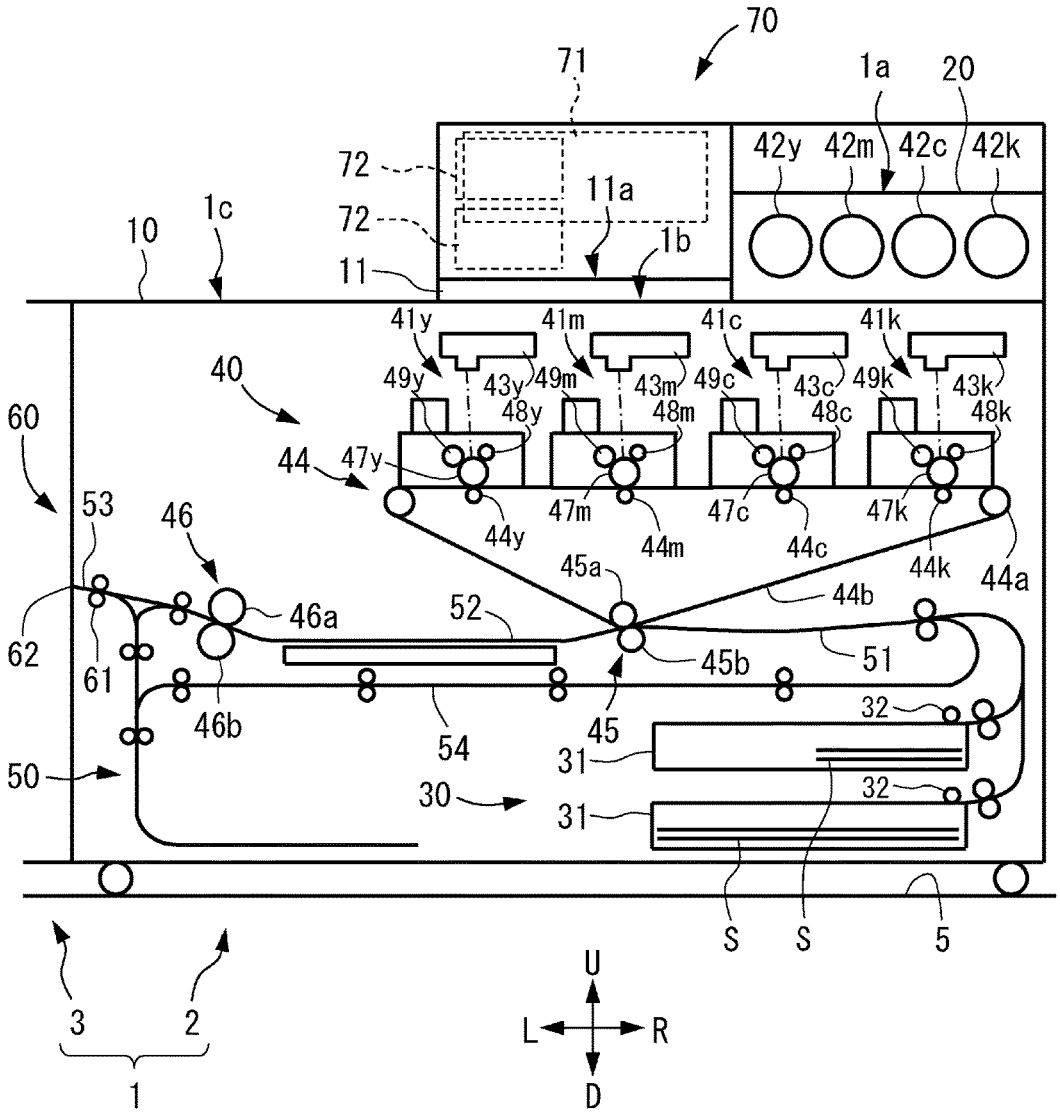
FIG. 2 is a schematic sectional view of the image forming apparatus of the image formation system shown in FIG. 1.

Referring to FIG. 2, the image forming apparatus 2 has a main assembly 10 (which hereafter will be referred to as apparatus main assembly). The apparatus main assembly 10 has a sheet feeding-conveying portion 30, an image forming portion 40, a sheet conveying portion 50, a sheet discharging portion 60, an electrical unit 70 (wall portion), and a control portion 80 (FIG. 1). By the way, a sheet S, which is a sheet of recording medium, is a sheet on which a toner image is formed. For example, it is a sheet of ordinary paper or cardstock, a sheet of film for an overhead projector, etc.

The sheet feeding-conveying portion 30 is disposed in the bottom portion of the apparatus main assembly 10. It has: a sheet cassette 31 in which sheets are stored in layers, and a sheet feeder roller 32. It feeds sheet S into the image forming portion 40.

The image forming portion 40 has image formation units 41*y*, 41*m*, 41*c* and 41*k*, toner bottles 42*y*, 42*m*, 42*c* and 42*k*, exposing devices 43*y*, 43*m*, 43*c* and 43*k*, an intermediary transfer unit 44, a secondary transferring portion 45, and a fixing device 46. The apparatus main assembly 10 has the image forming portion 40 which can form an image based on the information about the image to be formed.

The image forming portion 40 has four image formation units 41*y*, 41*m*, 41*c* and 41*k* for forming four monochromatic toner images, more specifically, yellow (Y), magenta (M), cyan (C), and black (K) toner images, respectively. These image formation units are individually and removably installable in the apparatus main assembly 10. For example, the image formation unit 41*y* has: a photosensitive drum 47*y* on which a toner image is formed; a charge roller 48*y*; a development sleeve 49*y*; an unshown drum cleaning blade; toner; etc. To the image formation unit 41*y*, toner is supplied from the toner bottle 42*y* filled with toner. The other image formation units 41*m*, 41*c* and 41*k* are the same in structure although they are different in the color of toner they contain. Therefore, they are not described in detail.

The exposing device 43*y* forms an electrostatic latent image on the peripheral surface of the photosensitive drum 47*y* by exposing the peripheral surface of the photosensitive drum 47*y*.

The intermediary transfer unit 44 is disposed in the bottom (D) direction of the image formation units 41*y*, 41*m*, 41*c* and 41*k*. It has multiple rollers, more specifically, a driver roller 44*a*, primary transfer rollers 44*y*, 44*m*, 44*c* and 44*k*, etc., and an intermediary transfer belt 44*b* suspended by some of these rollers. The primary transfer rollers 44*y*, 44*m*, 44*c* and 44*k* are disposed so that they oppose the photosensitive drums 47*y*, 47*m*, 47*c* and 47*k*, respectively, and contact the intermediary transfer belt 44*b*. As positive transfer bias is applied to the intermediary transfer belt 44*b* by the primary transfer rollers 44*y*, 44*m*, 44*c* and 44*k*, the toner images which are on the photosensitive drums 47*y*, 47*m*, 47*c* and 47*k*, one for one, and are negative in polarity, are sequentially transferred in layers onto the intermediary transfer belt 44*b*. Consequently, a full-color image is effected on the intermediary transfer belt 44*b*.

The secondary transferring portion 45 has secondary transfer rollers 45*a* and 45*b*, which are on the inward and outward sides, respectively, of the loop which the intermediary transfer belt 44*b* forms. It is designed so that as positive secondary transfer bias is applied to the outward secondary transfer roller 45*b*, the full-color image effected on the intermediary transfer belt 44*b* is transferred onto the sheet S. By the way, the inward secondary transfer roller 45*a* suspends and keeps tensioned the intermediary transfer belt 44*b* from within the belt loop. The outward secondary transfer roller 45*b* is positioned so that it opposes the inward secondary transfer roller 45*b*, sandwiching the intermediary transfer belt 44*b* between itself and inward secondary transfer roller 45*b*.

The fixing device 46 has a fixation roller 46*a* and a pressure roller 46*b*. It is structured so that as the sheet S is conveyed between the fixation roller 46*a* and pressure roller 46*b* while remaining pinched by the two rollers 46*a* and 46*b*, the toner image on the sheet S is subjected to heat and pressure, whereby it is fixed to the sheet S.

The sheet conveying portion 50 is structured so that as the sheet S is fed into the apparatus main assembly 2 from the sheet feeding-conveying portion 30, the sheet conveying portion 50 conveys the sheet S from the image forming portion 40 to the sheet discharging portion 60. It has a pre-secondary-transfer conveyance passage 51, a pre-fixation conveyance passage 52, a discharge passage 53, and a re-conveyance passage 54.

The sheet discharging portion 60 has: a pair of discharge rollers 61 disposed on the downstream side of the discharge passage 53; and a discharge opening 62 with which the left (L) wall of the apparatus main assembly 10 is provided. It is structured so that as the sheet S is fed into the nip of the pair of discharge rollers 61, the rollers 61 discharge the sheet S from the apparatus main assembly 2 through the discharge passage 53. The image formation system is structured so that the sheet S can be fed into the optional delivery device 3 disposed on the left (L) side of the apparatus main assembly 10.

Referring to FIGS. 1 and 2, the electrical unit 70 is disposed on the rear (B) side of the flat area 1*b* of the apparatus main assembly 10 in terms of the front-rear direction. In terms of the left-right direction, it is disposed on the left (L) side of the toner supply unit 20. It protrudes upward from the flat surface 1*b*. That is, in terms of the front-rear direction, it is at one end (rear end) of the top plate 11 (rear end of apparatus main assembly 10), and protrudes upward. In relation to the flat surface 1*b*, the top plate 11 (top plate portion) is on the front (F) side of the electrical unit 70. The top surface of the top plate 11 is utilized as a work area 11*a* (sheet placement surface) on which the sheet S can be placed after the image formation thereon. That is, the top plate 11 is on the top surface of the apparatus main assembly 10.

Figure 3:
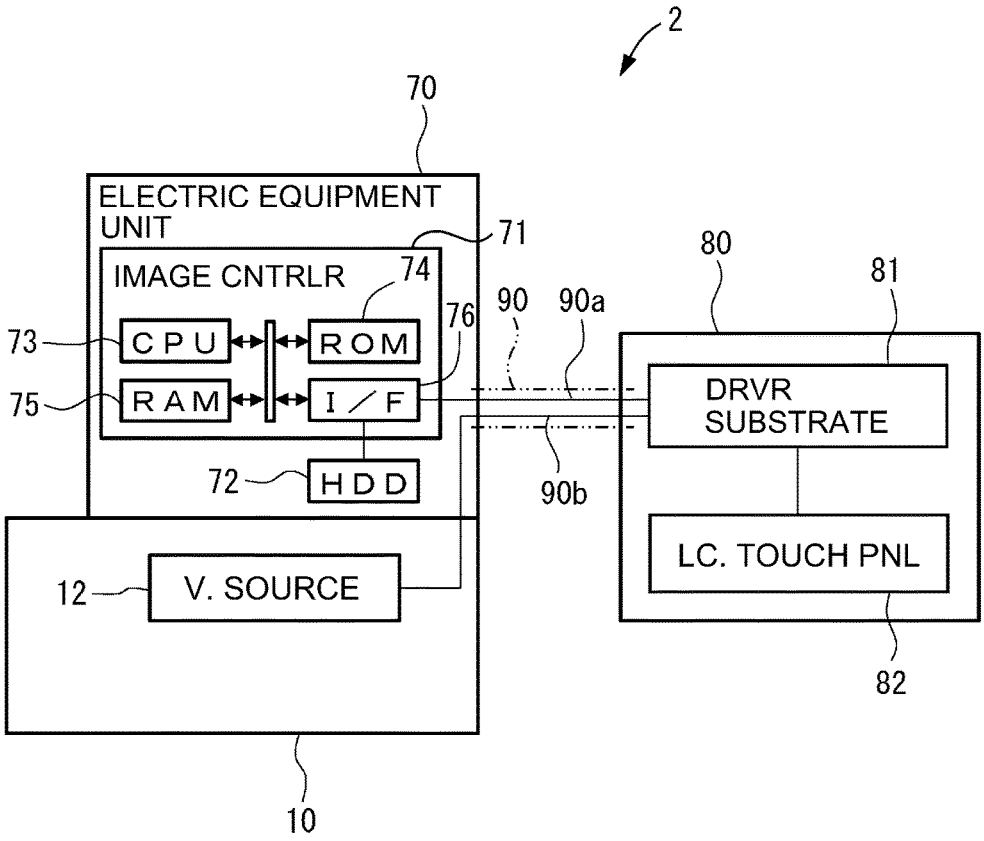
FIG. 3 is a block diagram of a combination of the electrical unit and control panel of the image forming apparatus shown in FIG. 1. It shows the relationship between them in terms of their connection to each other.

Referring to FIG. 3, the electrical unit 70 contains: an image controller 71 which is a control circuit board which includes the control portion; and a hard disk drive 72 (which hereafter will be referred to as HDD) which is a removable storage device with large capacity. The image controller 71 is made of a computer having a CPU 73, a ROM 74 for storing programs for controlling various portions of the apparatus, a RAM 75 for temporarily storing data, and an input/output circuit 76 (I/F) for inputting signals into the image controller 71 from various portions of the apparatus, or outputting signals to the various portions of the apparatus. The HDD 72 is a storing device with large capacity. It is for storing electrical data. It is removably installable in the image controller 71. It is capable of storing primarily image processing programs, digital image data, and information related to the digital image data. During an image forming operation, image data are read from the HDD 72.

The CPU 73 is a microprocessor which controls the entirety of image forming apparatus 2. It is the primary controller of the image forming apparatus 2. It is in connection to the sheet feeding-conveying portion 30, image forming portion 40, sheet conveying portion 50, sheet discharging portion 60, HDD 72, and control portion 80 through the input/output circuit 76. Not only does it exchange signals with each of the abovementioned portions, but also, controls the operation of each portion. Further, the image controller 71 executes commands from an unshown computer which is in connection to the apparatus main assembly 10, and also, can be used by a user through the control portion 80 to operate the image forming apparatus 2 or to input the setting for an image formation job.

The control portion 80 is physically independent from the apparatus main assembly 10. It is through the control portion 80 that a user can control various portions of the apparatus main assembly 10. The control portion 80 has a driver circuit board 81, and a liquid crystal touch panel 82. It is on the liquid crystal touch panel 83 that information such as the remaining amount of the sheets S and toner in the apparatus main assembly 10, messages for warming a user that the image forming apparatus 2 is running out of, or completely out of, expendable supplies such as sheet S, toner, etc., procedure for replenishing the apparatus main assembly 2 with expendable supplies, and information necessary for a user to operate the image forming apparatus 2, is displayed. Further, the liquid crystal touch panel 82 is enabled to accept from a user, information such as settings regarding the size and basis weight of the sheet S, information about image density adjustment, desired print count, etc.

The control portion 80 is in electrical connection to the electrical unit 70 of the apparatus main assembly 10 through a cable 90, which is a combination of a signal line 90*a* and an electrical power line 90*b* bound together. The signal line 90*a* connects between the input/output circuit 76 of the image controller 71 and the driver circuit 81, whereas the electric power line 90*b* connects between the electrical power source 12 of the apparatus main assembly 10 and the driver circuit 81.

Next, the image forming operation of the image forming apparatus 2 structured as described above is described.

As an image forming operation is started, first, the photosensitive drums 47*y*, 47*m*, 47*c* and 47*k* begin to be rotated, and the peripheral surface of each photosensitive drum 47 is charged by the charge rollers 48*y*, 48*m*, 48*c* and 48*k*, respectively. Then, a beam of laser light is emitted toward the photosensitive drum 47*y*, 47*m*, 47*c* and 47*k* by the exposing devices 43*y*, 43*m*, 43*c* and 43*k*, respectively, while being modulated according to the information of the image to be formed. Consequently, an electrostatic latent image is effected on the peripheral surface of each of the photosensitive drums 47*y*, 47*m*, 47*c* and 47*k*. Each of these electrostatic latent images is developed into a visible image, that is, an image formed of toner (which hereafter may be referred to simply as toner image) by the adhesion of toner to the electrostatic latent image. Then, the toner images are transferred onto the intermediary transfer belt 44*b*.

Meanwhile, the sheet feeding-conveying roller 32 is rotated in synchronism with the progression of the toner image forming operation described above, whereby the topmost sheet S in the sheet cassette 31 is moved out of the sheet cassette 31, while being separated from the rest of sheets S in the cassette 31, and is fed into the apparatus main assembly 10. Then, the sheet S is conveyed through the pre-secondary-transfer sheet conveyance passage 51 to the secondary transferring portion 45, with such timing that the toner images on the intermediary transfer belt 44*b* arrive at the secondary transferring portion 45 at the same time as the sheet S. Then, the toner images are transferred onto the sheet S from the intermediary transfer belt 44*b*. Then, the sheet S is conveyed to the fixing device 46, in which heat and pressure are applied to the unfixed toner images on the sheet S. Consequently, the toner images are fixed to the surface of the sheet S. Then, the sheet S is discharged by the pair of discharge rollers 61 through the discharge opening 62, into the optional discharging device 3.

Figure 4:
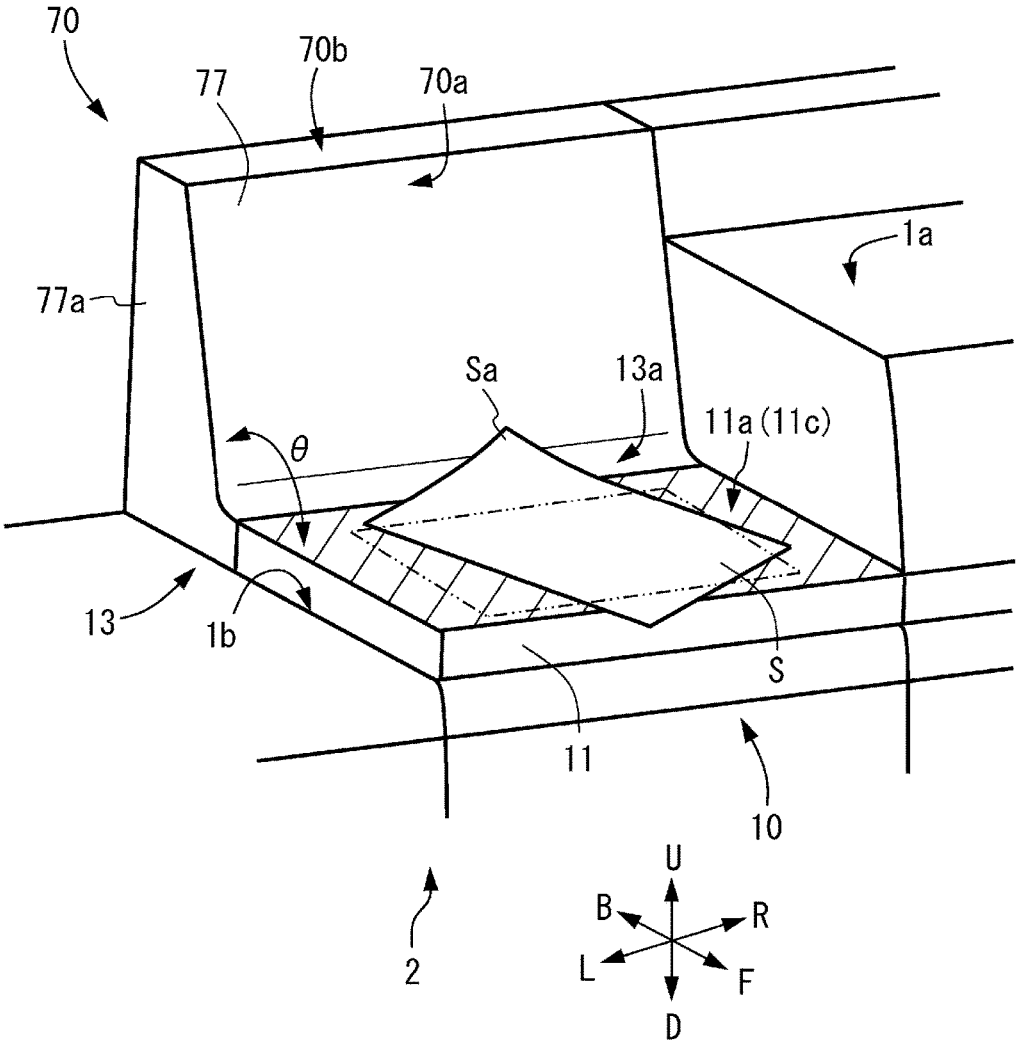
FIG. 4 is a perspective view of a combination of the work area, sheet catching surface, and guiding surface of the image forming apparatus shown in FIG. 1. It shows the relationship among them.
Figure 5:
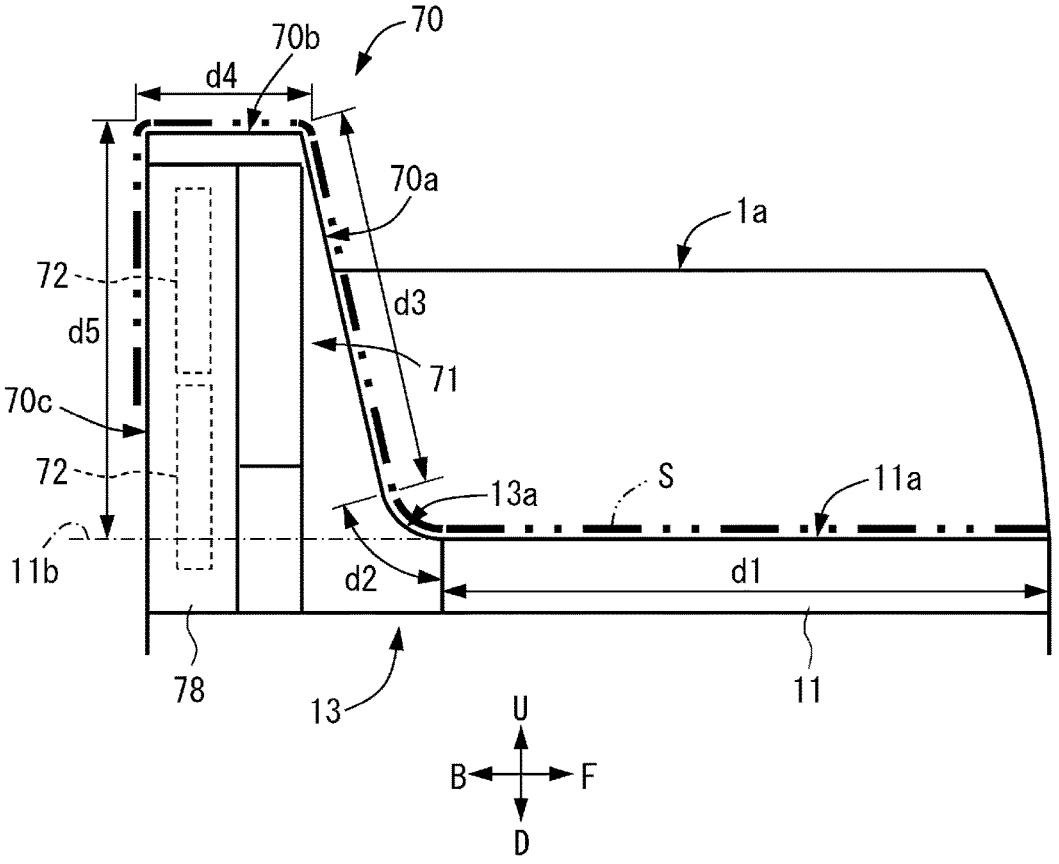
FIG. 5 is a side view of the combination of the work area, sheet catching surface, and guiding surface of the apparatus shown in FIG. 1. It shows the relationship among them.
Figure 6:
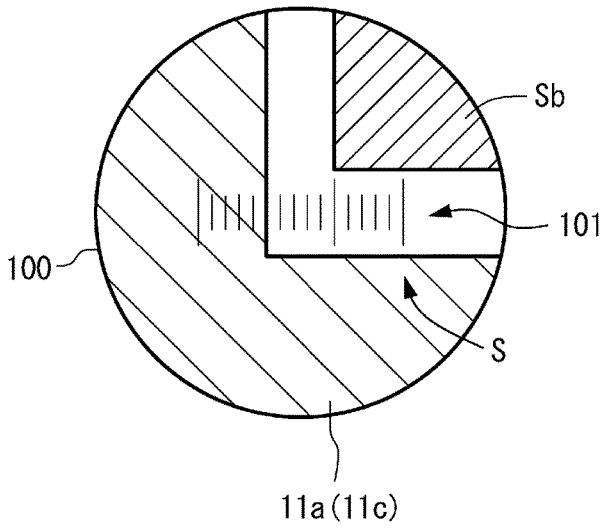
FIG. 6 is a drawing of one of the corner portions of a finished print, which is in the field of view of a magnifier.

Next, referring to FIGS. 4-6, the top plate 11 and electrical unit 70 are described in detail about their structure. By the way, in this embodiment, in order to examine the image on the sheet S outputted from the image forming apparatus 2, the top surface of the top plate 11 is utilized as the work area 11*a*. After the image is examined by a user, the control portion 80 is placed on the flat surface 1*c* to adjust the image forming apparatus 100 in image formation settings. That is, a user is to sequentially carry out operations of picking up the sheet S discharged from the optional delivery device 3, placing the sheet S on the work area 11*a*, examining the image formed on the sheet S, and inputting adjustment values into the control portion 80. Because the image forming apparatus 2 is structured as described above, the movements required of a user to examine the prints discharged from the apparatus main assembly 2 can be minimized. That is, a user can efficiently follow the workflow. The control portion 80 is disposed next to the top plate 11. The image forming portion 40 can be operated to control the image forming portion 40 in at least the image position relative to the sheet S and the image density, by inputting the information related to the image position and image density into the image forming apparatus 2 through the control portion 80.

Referring to FIG. 4, the top plate 11 is flat. It is fixed to the flat surface 1*b* of the apparatus main assembly 10. That is, unlike a pressure plate or the like, for example, for pressing an original, the top plate 11 is immovably fixed to the flat surface 1*b* of the apparatus main assembly 10. Therefore, it does not occur that the work area 11*a*, which is a part of the top surface of the top plate 11, vertically moves. Therefore, it is ensured that operations to be carried out on the work area 11*a* can be carried out without incident.

In this embodiment, the work area 11*a* of the top surface of the top plate 11 is rectangular. It is oriented so that its short edges are parallel to the front-rear direction of the apparatus main assembly 10. Regarding the size of the work area 11*a*, the length of the short edges of the work area 11*a* is greater than that of the short edges of the largest sheet S (largest recording medium) on which an image can be formed by the image forming portion 40, and is shorter than the long edges of the largest sheet S. Also in this embodiment, the long edges of the work area 11*a* are longer than the long edges of the largest sheet S. That is, the size of the work area 11*a* is greater than that of the largest sheet S (of size A3, for example) on which an image can be formed by the image forming apparatus 2. Thus, it is possible to place the sheet S on the work area 11*a* at least in such orientation that the short edges of the sheet S become parallel to the front-rear direction of the work area 11*a*.

Concretely, in this embodiment, the length of the work area 11*a* in terms of the left-right direction is set to 630 mm, for example, being greater than the length 483 mm of the longest sheet which the sheet cassette 31 is capable of feeding and conveying.

Further, the maximum width which a sheet S of recording medium which can be fed and conveyed out of the sheet cassette 31 is allowed to have is 330 mm. That is, the length of the work area 11*a* in terms of the front-rear direction was made to be 460 mm. Therefore, the work area 11*a* is such that all sizes of sheets S usable by the image forming apparatus 2 to output prints can be placed on the work area 11*a* without allowing the sheets S to extend beyond the work area 11*a*.

Referring to FIG. 5, the electrical unit 70 protrudes upward, that is, in the direction which is perpendicular to the rearward (B) direction, from the rear end of the top plate 11. In the case 77 (FIG. 4) of the electrical unit 70, the image controller 71 and HDD 72 are stored. The case 77 has an interface cover 77*a* (FIG. 4) which is on the left side of the case 77. The interface cover 77*a* can be opened to replace the HDD 72, etc. By the way, in order to prevent the HDD 72 from being accidentally removed while the image forming apparatus 1 is in operation, the electrical unit 70 is provided with a hard disk cover 27 which keeps the HDD 72 covered. Therefore, in order to remove the HDD 72 from the image forming apparatus 2, the hard disk cover 78 has to be opened after the interface cover 77*a* is opened.

Storing the image controller 71 in the electrical unit 70 makes it possible to position the interface connector of the image controller 71, and the removably installable HDD 72, on the rear side of the work area 11*a*, making it possible to position the interface connector and HDD 72 higher than the work area 11*a*. Therefore, the interface and/or HDD 72 can be installed or uninstalled as necessary, without interfering with the operation which is being carried out on the work area 11*a*, while minimizing the amount of movement required of a user.

The electrical unit 70 has: a sheet catching surface 70*a* which faces frontward (F); a top surface 70*b* which faces upward (direction U); and a rear surface 70*c* which faces rearward (B). The sheet catching surface 70*a* is slightly tilted rearward (B), forming an obtuse angle relative to the work area 11*a* of the top plate 11. In this embodiment, the sheet catching surface 70*a* has an angle (θ) of roughly 100° relative to the work area 11*a*. The top surface 70*b* is horizontal, and the rear surface 70*c* is vertical. The angle θ is desired to be in a range of 95°-110°.

There is a corner portion 13 (connective portion) between the work area 11*a* and sheet catching surface 70*a*. The corner portion 13 has a guiding surface 13*a* which connects the work area 11*a* and sheet catching surface 70*a*. In this embodiment, the guiding surface 13*a* is provided with concavity, as seen from the direction which is perpendicular to both the sheet catching surface 70*a* and work area 11*a*. Thus, the work area 11*a* gently transitions into the sheet catching surface 70*a*, and vice versa. Regarding the radius of the curvature of the guiding surface 13*a*, it is desired to be not less than 2 mm, for example. In this embodiment, it is 15 mm. However, if there is no restriction regarding the size of various portions of the image forming apparatus 2, the larger, the better.

In this embodiment, the case 77 of the electrical unit 70 and the corner portion 13 are formed as integral parts of a one-piece member. Therefore, unlike in a case where the case 77 of the electrical unit 70 and the corner portion 13 are independently formed from each other, there is no stairstep between the guiding surface 13*a* and sheet catching surface 70*a*. Therefore, when the sheet S is rotationally moved on the work area 11*a*, a corner portion Sa of the sheet S is smoothly guided (FIG. 4). Here, whether or not the corner portion Sa of the sheet S is folded back depends on the maximum amount by which the sheet S is made to curl by the thermal fixation or the like, as will be described later. Therefore, in a case where the amount by which the sheet S curls is relatively small, the angle θ of the sheet catching surface 70*a* relative to the work area 11*a* may be set close to 90°. On the other hand, in a case where the amount is large, the angle θ has to be increased. The maximum amount by which the sheet S is made to curl by a given image forming apparatus is dependent upon the type of the apparatus. Thus, the angle θ may be set according to the type of the image forming apparatus used to form an image on the sheet S. In this embodiment, however, the work area 11*a* is not an integral part of the case 77.

Next, referring to FIG. 5, d1 stands for the dimension of the work area 11*a* in terms of the front-rear direction, and d2 stands for the dimension of the guiding surface 13*a* in a plane which is perpendicular to both the work area 11*a* and sheet catching surface 70*a*. Further, d3 stands for the dimension of the sheet catching surface 70*a* in a plane which is perpendicular to both the work area 11*a* and sheet catching surface 70*a*, and d4 stands for the dimension of the top surface 70*b* of the electrical unit 70 in terms of the front-rear direction. Further, regarding the top-bottom direction, d5 stands for the dimension of the portion of the rear surface 70*c* of the electrical unit 70, which is between the top surface 70*b* and the theoretical extension of the work area 11*a*. In this embodiment, the electrical unit 70 is structured so that (d1+d2+d3+d4+d5) becomes greater than the dimension of the long edges of the largest sheet S. Therefore, it dos not occur that when a sheet S is placed on the work area 11*a* so that the front edge of the sheet S coincides with the front edge of the work area 11*a*, the center of gravity of the sheet S is positioned higher than the top surface 70*b*. Therefore, it does not occur that the sheet S falls backward (B) of the electrical unit 70.

Moreover, the work area 11*a* is made darker (hatched area in FIGS. 1 and 4) than the flat surfaces 1*a*, 1*c*, etc. As for the degree of darkness, it is desired to be set to no more than 4, for example, in Muncell value. More specifically, at least a part 11*c* of the work area 11*a* is made lower than 4 in Muncell value. By the way, the flat surface 1*c* is made lighter than the work area 11*a*.

When it is necessary to examine an image, by placing the image on the work area 11*a*, after the formation of the image, in particular, to adjust the image forming portion 40 in the image position relative to the sheet S, the distance between the edge of the sheet S and the image is measured with the use of a magnifier. In most cases, a sheet S is white or lightly colored. Therefore, giving the work area 11*a* dark color, such as black color, can increase the contrast between the sheet S and the work area 11*a*, to make it easier to see the edge of the sheet S. FIG. 6 shows one of the corner portions of the sheet S on the work area 11*a*, and its adjacencies, which are in the field of vision of a magnifier which is adjustable in magnification. As is evident from FIG. 6, the greater the contrast between the sheet S and work area 11*a*, the easier it is to see the scale 101 in the field 100 of vision. With the scale 101 being easier to see, it is possible to measure the margin portions of the print with the minimum amount of error, making it unnecessary to provide the image formation system 1 with an illumination dedicated for the examination. That is, giving the work area 11*a* dark color can increase the efficiency with which a user can examine the image Sb for adjusting the image forming apparatus 2.

Next, an operation which may be carried out by a user to examine a print (sheet S) after the formation of an image on the sheet S by the image forming apparatus 2 in this embodiment is described.

A user is to hold a sheet S discharged from the optional delivery device 3, and place the sheet S on the work area 11*a*. Then, the user is to measure the position of the image Sb relative to the sheet S. Since the dark portion 11*c* of the work area 11*a* in this embodiment is darker than the sheet S, the edges of the sheet S are clearly visible, and therefore, the user can easily align the scale 101 with the edges of the sheet S (or image Sb). Therefore, the position of the image Sb relative to the sheet S can be highly precisely and efficiently measured.

Next, referring to FIG. 4, the user is to rotate the sheet S in order to measure the positional relation between each of the four corner portions of the sheet S and the image Sb. As the sheet S is rotated, a corner Sa of the sheet S smoothly moves onto the sheet catching surface 70*a* from the work area 11*a* while being guided by the guiding surface 13*a*. Therefore, it does not occur that the sheet S is damaged. That is, this embodiment can improve an image forming apparatus in operational efficiency.

Next, the user is to measure the image Sb in density. When it is necessary to examine an image formed on a sheet S which is so thin that the work area 11*a* is visible through the sheet S, the flat surface 1*c* can be used to measure the image in density. Since the image formation system 1 is provided with two work areas, that is, surfaces (11*a* and 1*c*) different in degree of darkness (darker or lighter), it enables a user to deal with various types of sheet S. After obtaining the values for adjusting the image forming apparatus 2 in image position and density, the user is to input the adjustment values with the use of the control portion 80 to ensure that the image forming apparatus 2 forms images which are proper in position and density.

As described above, according to this embodiment, in the image forming apparatus 2, the angle θ of the sheet catching surface 70*a* relative to the work area 11*a* is obtuse, and the concave guiding surface 13*a* is provided between the sheet catching surface 70*a* and work area 11*a*. Therefore, as the sheet S is rotationally moved on the work area 11*a*, the corner portion Sa of the sheet S is guided to the sheet catching surface 70*a* by the guiding surface 13*a*. Therefore, it does not occur that as the sheet S is moved (rotated) on the work area 11*a*, the corner portion Sa of the sheet S comes into contact with a vertical surface. Therefore, it does not occur the corner portion Sa is folded back by its contact with a vertical wall. That is, this embodiment (present invention) can prevent the problem that a corner portion (portions) of a sheet S of recording medium buckles due to its contact with a vertical wall. Further, the electrical unit 70 is positioned on the rear side of the work area 11*a*. Therefore, it is possible to prevent the problem that a sheet S placed on the work area 11*a* falls behind an optional delivery device. That is, not only can the image formation system 1 in this embodiment prevent the sheet S placed on the top plate 11 from falling from the system, but also, prevent the problem that as the sheet S is moved (rotated) on the top plate 11, a corner portion Sa (portions) of the sheet S is made to buckle by a vertical wall.

Moreover, the sheet catching surface 70*a* is tilted backward, and the corner portion 13 having the guiding surface 13*a*, which is concave, is placed between the sheet catching surface 70*a* and work area 11*a*. Further, the corner portion 13 is formed as an integral part of the case 77 of the electrical unit 70. Therefore, as the sheet S is moved (rotated) on the work area 11*a*, the corner portion Sa of the sheet S is allowed to move to the sheet catching surface 70*a* along the guiding surface 13*a*, without hanging up. Further, the angle of the sheet catching surface 70*a* relative to the work area 11*a* is no less than 90°. Therefore, it can be avoided that as the sheet S slides onto the electrical unit 70, the portion of the sheet S, which has moved onto the electrical unit 70, folds backward onto the image on the sheet S, and covers the image.

Further, in this embodiment, both the case 77 of the electrical unit 70, and the corner portion 13, are integral parts of a one-piece member of the image forming apparatus 2. Therefore, unlike in a case where the case 70 of the electrical unit 70 and the corner portion 13 are physically independent from each other, there is no stairstep between the guiding surface 13*a* and sheet catching surface 70*a*. Therefore, as the sheet S is rotationally moved on the work area 11*a*, the corner portion Sa of the sheet S is smoothly guided onto the sheet catching surface 70*a*. That is, this embodiment can improve an image formation system 1 in operational efficiency.

In the above-described embodiment, the size of the largest sheet on which an image can be formed by the image forming apparatus 2 was A3. However, the embodiment is not intended to limit the present invention in the size of the sheet S usable with an image forming apparatus. For example, the present invention is also applicable to an image formation system comprising the image forming apparatus 2 in the above-described embodiment, and a sheet feeding-conveying device 6 which is capable of handling a sheet, the long edges of which are 1200 mm in length. By the way, some users do not need the sheet conveying-feeding device 6 for feeding and conveying a sheet of an unusual size such as the abovementioned one. Therefore, a sheet feeding-conveying device such as the above-described sheet-feeding conveying device 6 is employed only as necessary.

Referring to FIG. 5, in a case where a sheet S of the largest size is rotationally moved on the work area 11*a* to examine the image on the sheet S, it is possible that the sheet S (indicated by two-dot broken line) will slide onto the electrical unit 70, far enough for the sheet S to extend beyond the rear edge of the top surface 70*b* of the electrical unit 70. If the sheet S moves rearward (B) far enough for the center of gravity of the sheet S to be positioned beyond the top surface 70*b*, it is possible that the sheet S will droop down along the rear wall 70*c*, and fall behind the image forming apparatus 2. In this embodiment, however, (d1+d2+d3+d4+d5) is made to be greater than the length of the long edge of the largest sheet S usable with the image forming system 1. Therefore, when the sheet S is placed on the work area 11*a* so that the front edge of the sheet S aligns with the front edge of the work area 11*a*, it does not occur that the center of gravity of the sheet S is positioned beyond the top surface 70*b*. That is, the embodiment (present invention) can prevent the problem that the sheet S pulls itself rearward (B) and falls behind the electrical unit 70.

Figure 7:
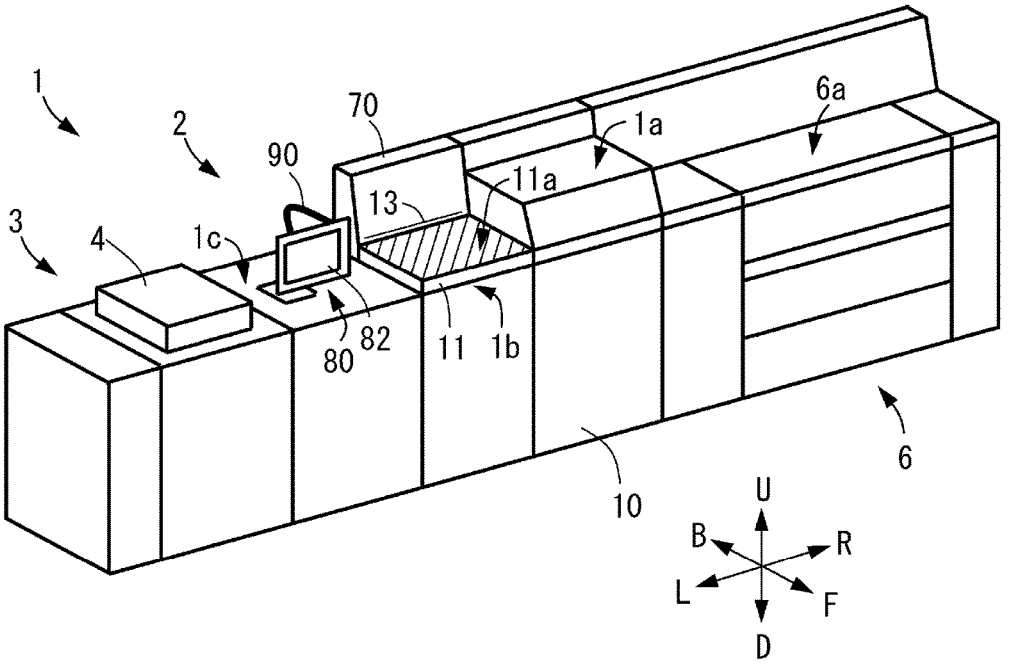
FIG. 7 is a perspective view of one of the modifications of the image formation system shown in FIG. 1.

In the case of the image formation system 1 shown in FIG. 7, an operation for measuring a print can be carried out with the use of the top surface 6*a* of the sheet feeding-conveying device 6, which is wider than the work area 11*a*.

Further, in this embodiment, the entirety of the work area 11*a* is given the same dark tone. This embodiment, however, is not intended to limit the present invention in scope in the characteristics of the work area 11*a*. For example, the front and left edge portions of the work area 11*a* may be made darker (11*c*) than the rest, as shown in part (a) of FIG. 8, or the work area 11*a* may be provided with four dark areas which protrude from the four corners of the work area 11*a*, toward the center of the work area 11*a*, one for one. That is, at least one corner portion of the work area 11*a* is made darker than the rest. By the way, what is measured during the examination of the print is more likely to be the distance between the edge or corner of a sheet S and the image (image formation area) on the sheet S. In comparison, the portions of a print that are closer to the center of the print are more likely to be measured in color tone and/or density. Therefore, by dividing the work area 11*a* into a dark area 11*c* which extends along the left and front edges of the work area 11*a*, and a light area which occupies the rest of the work area 11*a*, as shown in part (a) of FIG. 8, or four dark areas 11*c* which extend from the four corner portions of the work area 11*a* toward the center of the work area 11*a*, and the light area 11*d*, which occupies the rest, as shown in part (b) of FIG. 8, it is possible to efficiently examine a print and adjust the image forming apparatus 2 whether or not the sheet S is transparent.

Moreover, in this embodiment, the electrical unit 70 is disposed on the rear side of the work area 11*a*, and the front surface of the electrical unit 70 was utilized as the sheet guiding surface. However, this embodiment is not intended to limit the present invention in scope in terms of applicability. For example, instead of placing the electrical unit 70 on the rear side of the work area 11*a*, a simple wall may be erected on the rear side of the work area 11*a* so that its front surface can be utilized as the sheet catching surface 70*a*.

Further, in this embodiment, the image forming apparatus 2 was a part of the image formation system 1 which has the optional sheet delivery device 3. However, this embodiment is not intended to limit the present invention in scope in terms of its applicability. For example, the present invention is applicable also to a plain image forming apparatus having an image reading portion, a delivery tray, etc.

Further, in this embodiment, the sheet catching surface 70*a* was disposed on the rear (B) side of the work area 11*a*. However, this embodiment is not intended to limit the present invention in scope in terms of applicability. That is, not only is the present invention applicable to an image formation system such as the one in this embodiment, but also, to an image forming system having the sheet catching surface 70*a* on the left or right side of the work area 11*a*.

Further, in this embodiment, the work area 11*a* was rectangular, and its long edges were parallel to the left-right direction. However, this embodiment is not intended to limit the present invention in scope in applicability. For example, the present invention is also applicable to an image formation system having a rectangular work area 11*a*, the long edges of which are parallel to the front-rear direction, a square work area 11*a*, or a work area 11*a* which is neither rectangular nor square.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-127426 filed on Jun. 25, 2015, which is hereby incorporated by reference herein in its entirety.

What is claimed is:

1. An image forming apparatus comprising:

a main assembly including an image forming station configured to form an image on the basis of image information;

a toner bottle mounting portion provided on an upper portion of said main assembly, configured to mount a toner bottle, and configured to supply toner into said image forming station from the toner bottle mounted to said toner bottle mounting portion;

a top plate portion provided on the upper portion adjacent to said toner bottle mounting portion with respect to a direction crossing with a front-rear direction and with a vertical direction of the image forming apparatus, said top plate portion including a stacking surface having a length, in the front-rear direction of said main assembly, which is longer than 330 mm and shorter than 483 mm;

a wall portion provided at the upper portion adjacent to said toner bottle mounting portion with respect to the crossing direction and behind said top plate portion with respect to the front-rear direction, said wall portion including a wall surface protruding upward relative to said stacking surface; and a connecting portion having a curved surface configured to connect said stacking surface with said wall surface.

2. An apparatus according to claim 1, wherein said stacking surface has a rectangular shape having a short side along the front-rear direction, and two sides thereof surrounded by said toner bottle mounting portion and said wall portion.

3. An apparatus according to claim 2, wherein a long side of said stacking surface is longer than 483 mm.

4. An apparatus according to claim 1, wherein said wall portion and said connecting portion are integral with each other.

5. An apparatus according to claim 1, wherein said wall surface is inclined so as to form an obtuse angle relative to said stacking surface, and the obtuse angle is not less than 95 degrees and not more than 110 degrees.

6. An apparatus according to claim 1, wherein said wall portion is part of a wall of an electrical unit, which wall forms an inside space accommodating an image controller.

7. An apparatus according to claim 6, wherein said electrical unit includes a hard disk drive detachably mounted in the inside space.

8. An apparatus according to claim 1, wherein the curved surface has a curvature radius of not less than 2 mm.

9. An apparatus according to claim 1, wherein said stacking surface has a color darker than that of other surfaces of said image forming apparatus, the color having a Munsell value of not higher than 4.

10. An image forming apparatus comprising:

a main assembly including an image forming station configured to form an image on the basis of image information;

a toner bottle mounting portion provided on an upper portion of said main assembly, configured to mount a toner bottle, and configured to supply toner into said image forming station from the toner bottle mounted to said toner bottle mounting portion;

a top plate portion provided on the upper portion adjacent to said toner bottle mounting portion with respect to a direction crossing with a front-rear direction and with a vertical direction of the image forming apparatus, said top plate portion including a stacking surface having a length, in the front-rear direction of said main assembly, which is longer than 297 mm and shorter than 420 mm;

a wall portion provided at the upper portion adjacent to said toner bottle mounting portion with respect to the crossing direction and behind said top plate portion with respect to the front-rear direction, said wall portion including a wall surface protruding upward relative to said stacking surface; and a connecting portion having a curved surface configured to connect said stacking surface with said wall surface.

11. An apparatus according to claim 10, wherein said stacking surface has a rectangular shape having a short side along the front-rear direction, and two sides thereof surrounded by said toner bottle mounting portion and said wall portion.

12. An apparatus according to claim 11, wherein a long side of said stacking surface is longer than 420 mm.

13. An apparatus according to claim 10, wherein said wall portion and said connecting portion are integral with each other.

14. An apparatus according to claim 10, wherein said wall surface is inclined so as to form an obtuse angle relative to said stacking surface, and the obtuse angle is not less than 95 degrees and not more than 110 degrees.

15. An apparatus according to claim 10, wherein said wall portion is part of a wall of an electrical unit, which wall forms an inside space accommodating an image controller.

16. An apparatus according to claim 10, wherein the curved surface has a curvature radius of not less than 2 mm.

17. An apparatus according to claim 10, wherein said stacking surface has a color darker than that of other surfaces of said image forming apparatus, the color having a Munsell value of not higher than 4.

* * * * *